United States Patent [19]

Hendry

[11] 4,298,821

[45] Nov. 3, 1981

[54] ELECTRON TUBE WITH PARTICLE TRAP INTEGRAL WITH ENVELOPE WALL

[75] Inventor: Eric D. Hendry, Chelmsford, England

[73] Assignee: English Electric Valve Company, Chelmsford, England

[21] Appl. No.: 74,672

[22] Filed: Sep. 12, 1979

[30] Foreign Application Priority Data

Sep. 15, 1978 [GB] United Kingdom ..... 36969/78

[51] Int. Cl.[3] ..... H01J 29/84; H01J 29/88

[52] U.S. Cl. ..... 313/477 R; 313/242; 313/479

[58] Field of Search ..... 313/477, 479, 424, 446, 313/451, 242, 383, 393, 414

[56] References Cited

U.S. PATENT DOCUMENTS 2,841,728 7/1958 McGee ..... 313/242 X 3,183,388 5/1965 Townsend et al. ..... 313/451

3,560,779 2/1971 May ..... 313/414

OTHER PUBLICATIONS

"Combination Bulb Spacer and Glass Particle Trap", by W. R. Poff, *RCA Technical Notes*, PN-1136, 2 pp., Dec. 19, 1975.

*Primary Examiner*—Palmer C. Demeo

*Attorney, Agent, or Firm*—Diller, Ramik & Wight

[57] ABSTRACT

The invention provides a television camera tube having between the gun thereof and its target a baffle member formed as a wall integral with the tube and extending inwardly and towards the gun to provide a particle receiving cavity extending around the path of the beam of the gun for retaining loose particles originating from the gun and which would otherwise land upon the target of the tube when this is operated in a "face-down" position.

3 Claims, 2 Drawing Figures

ELECTRON TUBE WITH PARTICLE TRAP INTEGRAL WITH ENVELOPE WALL

This invention relates to electronic tubes and more specifically to electronic tubes of the kind in which a target is arranged to be scanned by an electron gun. Examples of such electron tubes include low light level camera tubes such as image isocons which are often required to operate under conditions of vibration in the face-down position. In circumstances such as this it is not uncommon for blemishes to be experienced in the tube output and it has been found that a cause of such blemishes is particles shaken loose from the gun which fall upon the target and/or photocathode.

The object of the present invention is to reduce this difficulty.

According to this invention an electron tube having a target arranged to be scanned by an electron gun is provided and wherein between said electron gun and said target means are provided for retaining loose particles originating from said gun and which would otherwise fall upon said target when said tube is operated in a face-down position.

By "face-down" is meant that the target of the tube is below said electron gun e.g. vertically below.

Preferably said retaining means comprises a baffle member providing a particle receiving cavity extending around the path of the electron beam from said gun from said target.

Preferably said baffle member is formed as part of the envelope of said tube and comprises an internal wall extending inwardly and towards said gun.

Whereas will commonly be the case the interior of the tube envelope is provided with a conductive coating so as to provide a so-called wall anode, normally said wall forming said baffle member is also provided with a conductive coating, preferably on both sides.

Figure 1:
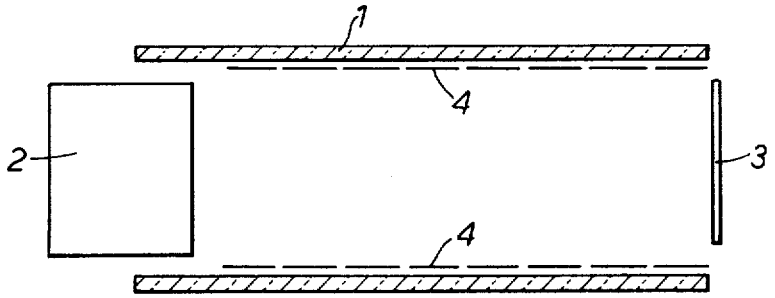
PRIOR ART FIG. 1.
Figure 2:
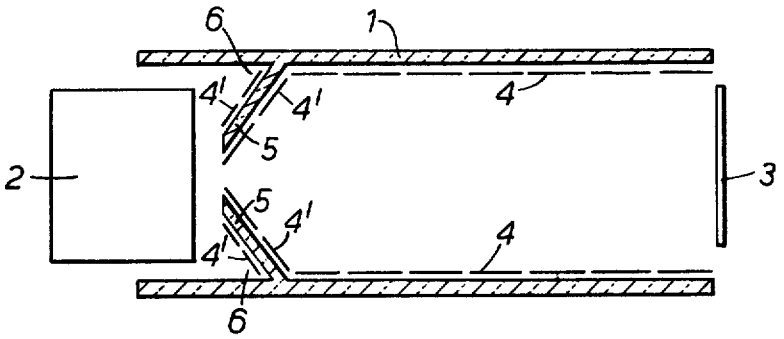

The invention is further described with reference to the accompanying drawing in which FIG. 1 is a highly schematic representation of part of a low light level television camera tube of the isocon type in accordance with the present invention, and FIG. 2 represents the structure of FIG. 1 modified in accordance with the present invention.

Referring to FIG. 1 the part of the tube illustrated thereby comprises a glass envelope 1 circular in cross section enclosing at one end an electron scanning beam gun 2 and at the other end a target electrode 3. The interior of the envelope 1 is provided with a conductive coating of aluminium represented by the dashed lines 4 which form a wall anode.

With a tube as described with reference to FIG. 1 if this is operated in a face-down position i.e. with the target 3 below electron gun 2 and at the same time the tube is subjected to vibration particles from the electron gun 2 can fall onto the surface of the target 3 and result in blemishes as herein before mentioned.

Referring to FIG. 2 in which like references are used for like parts in FIG. 1 it will be seen that the general construction of the tube is similar except for the provision of a glass baffle member 5 which is provided as a wall integral with the tube envelope 1 and extending inwardly and towards the electron gun 2 so as to provide a cavity 6 surrounding the path of the electron beam from the gun 2 to the target 3. Now when the tube is operated in a face-down position and subjected to vibration, at least some of any particles coming loose from the electron gun 2 will be trapped within the cavity 7 and thus prevented from falling upon the target 3.

As will be seen the aluminium coating 4 extends over the wall 5 to cover both sides thereof.

I claim:

1. An electron tube having a tube envelope, and a target arranged to be scanned by an electron beam generated by an electron gun and wherein between said electron gun and said target a baffle member formed as a wall integral with the tube envelope is provided extending inwardly and towards said gun to provide a particle receiving cavity extending around the path of said electron beam from said gun to said target for retaining loose particles originating from said gun and which would otherwise fall upon said target when said tube is operated in a face-down position.

2. A tube as claimed in claim 1 and wherein the interior of the tube envelope is provided with a conductive coating so as to provide a so-called wall anode and wherein said wall forming said baffle member is also provided with a conductive coating.

3. A tube as claimed in claim 2 and wherein said conductive coating provided on said wall forming said baffle member is provided on both sides of said wall.

* * * * *